US006580888B2

(12) United States Patent
Horrall et al.

(10) Patent No.: US 6,580,888 B2
(45) Date of Patent: Jun. 17, 2003

(54) CONTACT DEVELOPMENT SYSTEM REFERENCE STRUCTURE

(75) Inventors: Paul Douglas Horrall, Lexington, KY (US); Franklin Joseph Palumbo, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/859,909

(22) Filed: May 17, 2001

(65) Prior Publication Data

US 2002/0172529 A1 Nov. 21, 2002

(51) Int. Cl.[7] ..... G03G 15/04; G03G 15/00

(52) U.S. Cl. ..... 399/119; 399/110; 399/116; 399/117

(58) Field of Search ..... 399/119, 110, 399/116, 126, 117

(56) References Cited

U.S. PATENT DOCUMENTS 4,432,632 A * 2/1984 Yokota ..... 399/119
4,674,858 A * 6/1987 Nagayama ..... 399/116
4,757,344 A * 7/1988 Idenawa et al. ..... 399/119
4,862,212 A * 8/1989 Tanzawa et al. ..... 399/110
4,876,572 A * 10/1989 Nagatsuna ..... 399/116
4,888,620 A * 12/1989 Fujino et al. ..... 399/110
4,908,661 A * 3/1990 Iwata et al. ..... 399/116
5,105,221 A 4/1992 Takahashi et al.
5,204,713 A * 4/1993 Yamamura ..... 399/119
5,266,998 A 11/1993 Lee
5,450,166 A * 9/1995 Yashiro
5,508,785 A 4/1996 Takahashi et al.
5,615,001 A 3/1997 Kawashima et al.
5,669,042 A 9/1997 Kobayashi et al.
5,745,825 A 4/1998 Okawa et al.
5,758,243 A 5/1998 Haneda et al.
5,787,324 A 7/1998 Iwasaki
5,799,230 A 8/1998 Lloyd
6,101,349 A 8/2000 Ohashi et al.
6,101,350 A * 8/2000 Suzuki et al. ..... 399/119
6,198,891 B1 * 3/2001 Ishida et al. ..... 399/116

* cited by examiner

*Primary Examiner*—Susan S. Y. Lee
(74) *Attorney, Agent, or Firm*—Taylor & Aust, P.C.

(57) ABSTRACT

A developer reference system for a contact development process having machine frame mounted support rollers for the developer roll. Skew between the PC drum and the developer roll is reduced by referencing each to the same support structure. Rolling resistance of the developer roll support rollers is reduced by using thin diameter metal pins for mounting the support rollers.

20 Claims, 4 Drawing Sheets

CONTACT DEVELOPMENT SYSTEM REFERENCE STRUCTURE

BACKGROUND OF THE INVENTION

1. Field of the Invention

The present invention relates to a contact development system in an electrophotographic imaging apparatus, and, more particularly, to a structure and method for referencing a developer roll to the photoconductive drum in a contact development system.

2. Description of the Related Art

In an electrophotographic imaging apparatus, such as a printer or copier, a photosensitive member, such as a photoconductive drum or belt, is uniformly charged over the surface thereof. An electrostatic latent image is formed by selectively exposing the uniformly charged surface of the photosensitive member. Microscopic marking particles, known as toner, are applied to the electrostatic latent image, and subsequently transferred to the media intended to receive the final, permanent image, which may be paper, an envelope, a transparency or the like. The toner image is fixed to the media by the application of heat and pressure in a fuser.

The application of toner to the electrostatic image on the photosensitive member is commonly referred to as developing or development, and the apparatus for applying the toner to the photoconductive drum or other photosensitive member is commonly referred to as a developing or development unit. The developing unit includes a housing having a compartment therein for containing toner, and a developer roll rotatably supported within the housing. A uniform layer of toner is applied to the developer roll by a supply roll or the like. In what is referred to as a contact development method, the developer roll is rotatably disposed in contact with the photosensitive member, and the developer roll applies a layer of toner directly to the surface of the photoconductive member.

In a contact development system, it is important to keep a constant nip force between the developer roll and the photoconductive drum over the entire length of the developer roll. Constant nip force ensures a uniform application of toner to the surface of the photoconductive drum. If the developer roll is not parallel to the photoconductive drum, the nip force along the developer roll varies, and the toner delivered to the photoconductive drum will not be uniform. Non-uniform application of toner to the photoconductive drum ultimately results in print quality defects.

It is known to support opposite ends of the developer roll on separate rollers mounted in the developer cartridge. The developer roll is spring biased against the photoconductive drum, even though the developer roll can float relative to the photoconductive drum surface. Referencing systems of this type can result in skew between the photoconductive drum and developer roll. Further, as the developer roll rides against the support rollers, the support rollers should rotate freely. However, friction can inhibit support roller rotation, causing uneven wear on the outer surface thereof. This is particularly problematic when, as commonly provided, the support rollers and/or pins mounting the support rollers are made of plastic or the like. Plastic components may deflect, causing skew. Plastic pins mounting the support rollers in the housing are often large in diameter, increasing rolling friction. Skew between the developer roll and the photoconductive drum, and friction in the support rollers are two major contributors to non-uniform nip forces between the developer roll and photoconductive drum. Occurrence of either can result in print quality defects.

The developer cartridge is a replaceable unit, having a life expectancy shorter than that of the base machine in which it operates. When properly operated, the support rollers do not wear excessively, and may not require replacement during the entire anticipated lifespan of the base machine. Therefore, providing the support rollers as part of the developer cartridge is wasteful, resulting in the unnecessary replacement thereof when the developer cartridge is replaced. Thus, needless expense is incurred.

What is needed is a referencing apparatus for a contact development system which minimizes or eliminates skew between the developer roll and photoconductive drum and which reduces friction in the rotation of developer roll support rollers.

SUMMARY OF THE INVENTION

The present invention provides a supporting, or reference structure for a contact development system, that references the developer roll to the same structure as the photoconductive drum, thereby eliminating a variable in the reference structure.

The invention comprises, in one form thereof, a photo imaging apparatus comprising a machine frame including a photoconductive member support assembly and a photoconductive member mounted in said photoconductive member support assembly. A developer cartridge includes a developer roll for applying toner to the photoconductive member. A developer cartridge support assembly includes a reference component mounted on the photoconductive member support assembly and a support component supporting the developer cartridge on the reference surface.

The invention comprises, in another form thereof a contact development system for applying toner to a photoconductive drum in an electrophotographic imaging machine, comprising a photoconductive drum support assembly and a developer cartridge including a housing and a developer roll rotatably mounted in the housing. A reference surface is provided in the photoconductive drum support assembly; and a developer cartridge support extends between the cartridge and the reference surface.

The invention comprises, in still another form thereof, a developer roll referencing apparatus for a contact developing system in an electrophotographic imaging machine having a machine frame and a photoconductive drum mounted in said machine frame. The development system includes a developer cartridge having a housing and a developer roll. The referencing apparatus comprises a reference surface in the machine frame, and a support body for the cartridge, the support body disposed on the reference surface.

The invention comprises, in a further form thereof, a method for referencing a developer roll to a photoconductive drum in a contact development system of an electrophotographic imaging machine. The method comprises providing a photoconductive drum support structure and a reference surface in the structure; providing a developer roll for rotation in contact with the photoconductive drum; urging the roll against the photoconductive drum; and supporting the roll by sliding engagement with the reference surface.

An advantage of the present invention is providing a common mounting component for the photoconductive drum and developer roll support rollers, which substantially reduces the potential for skew between the photoconductive drum and the developer roll, compared to mounting structures known heretofore.

Another advantage is providing a more stable mounting component for the developer roll support rollers.

Yet another advantage is eliminating the unnecessary replacement of developer roll support rollers by placing the support rollers in permanent structural frame components rather than in replaceable unit housings.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
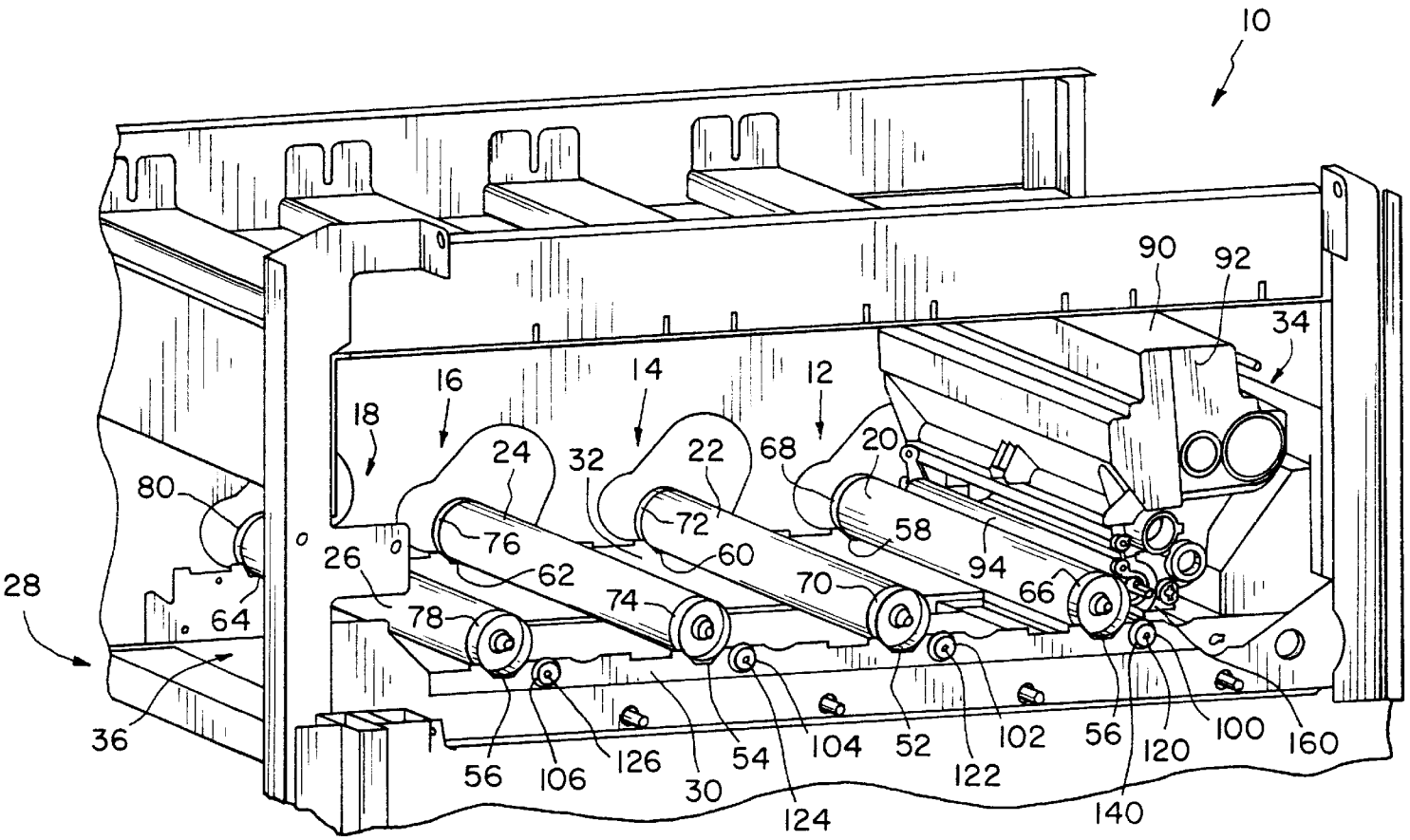
FIG. 1 is a perspective view of a color printer, having some parts removed, and having a contact development system according to the present invention.
Figure 2:
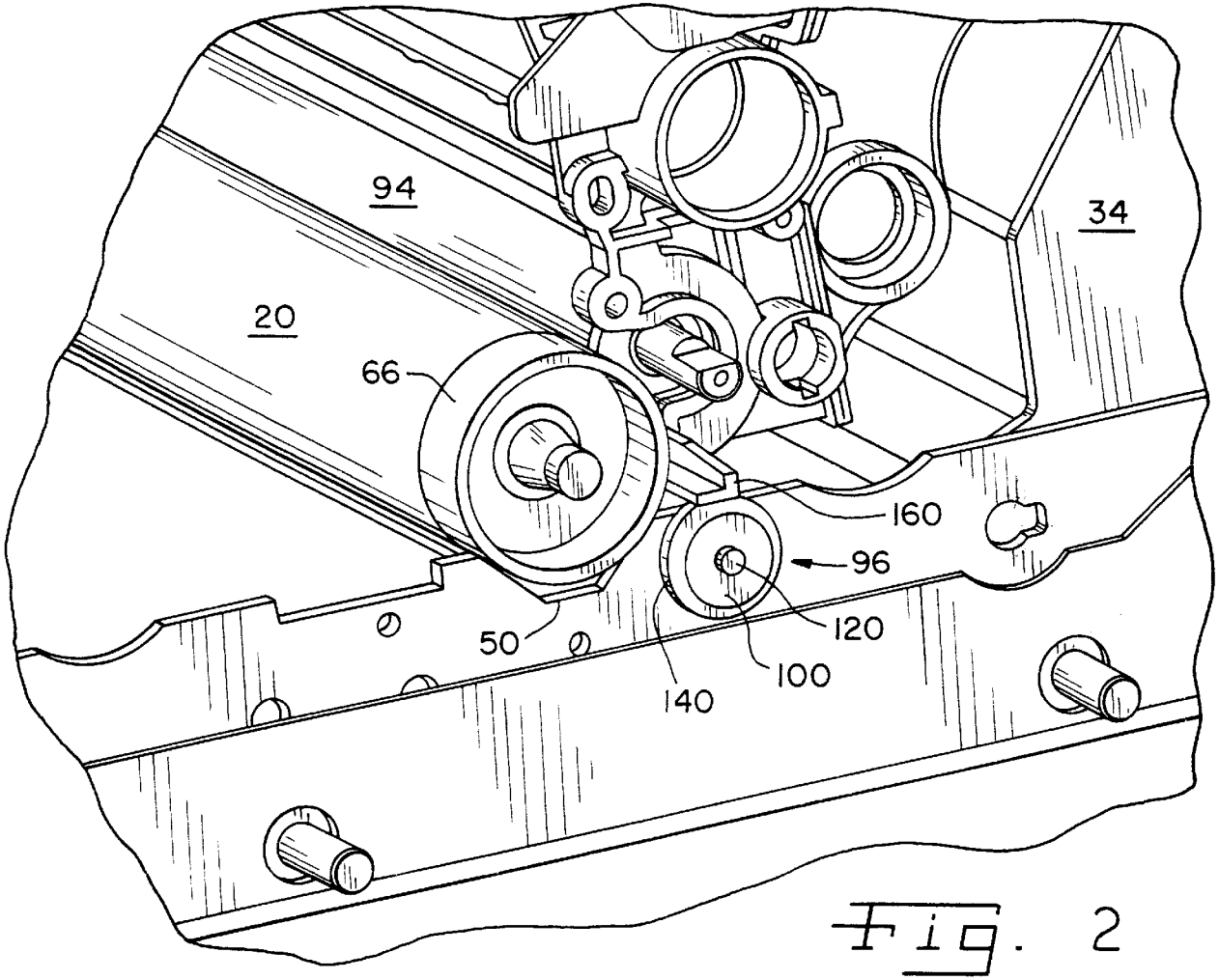
FIG. 2 is an enlarged view of a portion of the printer shown in FIG. 1.

Referring now to the drawings, and particularly to FIG. 1, there is shown a photo imaging apparatus 10, which is an electrophotographic printer or the like. Photo imaging apparatus 10 is a color printer, and includes four printing stations 12, 14, 16 and 18 for printing magenta, yellow, cyan and black images. Each printing station 12, 14, 16 and 18 includes a photoconductive member such as PC drums 20, 22, 24 and 26, respectively. PC drums 20, 22, 24 and 26 are secured to a machine frame assembly 28, which includes a front v-bar 30 and a back v-bar 32. Each printing stations 12, 14, 16 and 18 includes a developer cartridge, one such developer cartridge 34 being shown for printing station 12. It should be understood that each printing station includes a similar developer cartridge 34; however, only one such developer cartridge 34 is shown for simplicity and clarity in description. The manner in which developer cartridge 34 is associated with printing station 12, and specifically PC drum 20 of printing station 12, is similar to the manner in which other such developer cartridges are associated with printing stations 14, 16, 18 and PC drums 22, 24 and 26, respectively.

A photoconductive member or PC drum support assembly 36 for each PC drum 20, 22, 24 and 26 includes front v-bar 30 and back v-bar 32, which are primary support components, and are rigid and strong. Front v-bar 30 includes a plurality of precisely located notches 50, 52, 54 and 56. Back v-bar 32 includes a similar plurality of notches 58, 60, 62 and 64. Front v-bar 30 and back v-bar 32 are accurately positioned and securely fastened members of frame assembly 28, and define end support rails for PC drums 20, 22, 24 and 26. PC drum 20 includes end rings 66 and 68 positioned in notches 50 and 58, respectively. PC drum 22 includes end rings 70 and 72 positioned in notches 52 and 60, respectively. PC drum 24 includes end rings 74 and 76 positioned in notches 54 and 62, respectively. PC drum 26 includes end rings 78 and 80 positioned in notches 56 and 64, respectively.

The construction of the PC drums 20, 22, 24 and 26, the manner in which PC drums are positioned and retained by front and back v-bars 30 and 32, respectively, and the like are well known to those skilled in the art and will not be described in further detail herein, except as relates specifically to the present invention. Similarly, printing stations 12, 14, 16 and 18 include numerous additional components, known to those skilled in the art, and required for creating the electrostatic image and attaching the toner particles thereto. However, such are not shown in the drawings, again for simplicity and clarity in description, and will not be described in further detail herein.

Printing stations 12, 14, 16 and 18 of apparatus 10 include contact development systems of developer cartridge 34. Each developer cartridge 34 is similar, and only a single developer cartridge 34 is described in detail herein.

Developer cartridge 34 includes a housing 90 defining a toner compartment 92 from which toner is deposited on the electrostatic image created on PC drum 20. A plurality of rolls and the like are provided for metering toner from toner compartment 92, to provide a consistent deposit thereof on a developer roll 94. For an even deposit of toner on the surface of PC drum 20, developer roll 94 must be held in precise parallel relationship with PC drum 20, and maintain contact therewith essentially along the entire length of the nip between developer roll 94 and PC drum 20.

Figure 3:
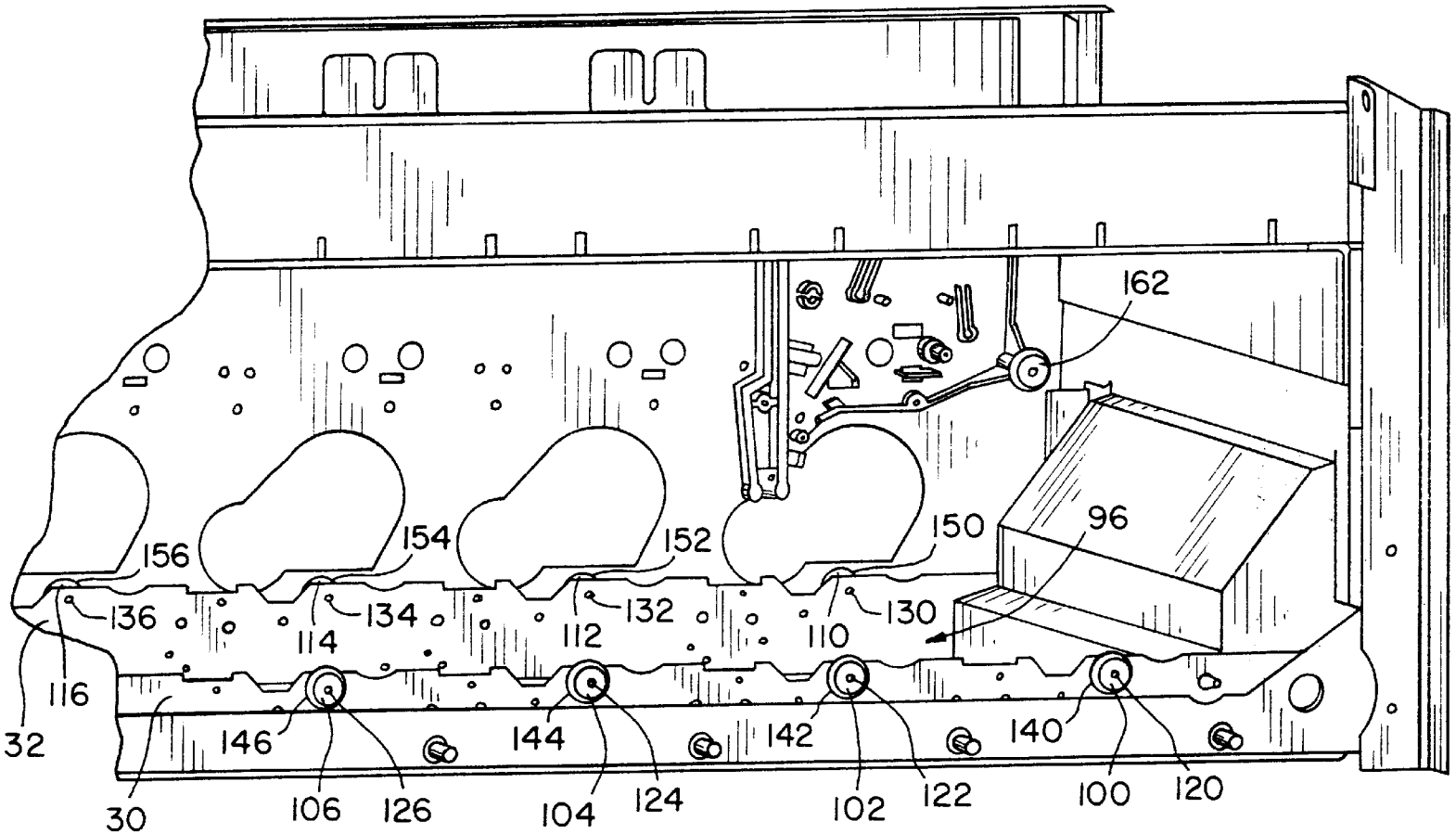
FIG. 3 is an enlarged partial, view similar to FIG. 1, but having additional components of the printer removed for added clarity.
Figure 4:
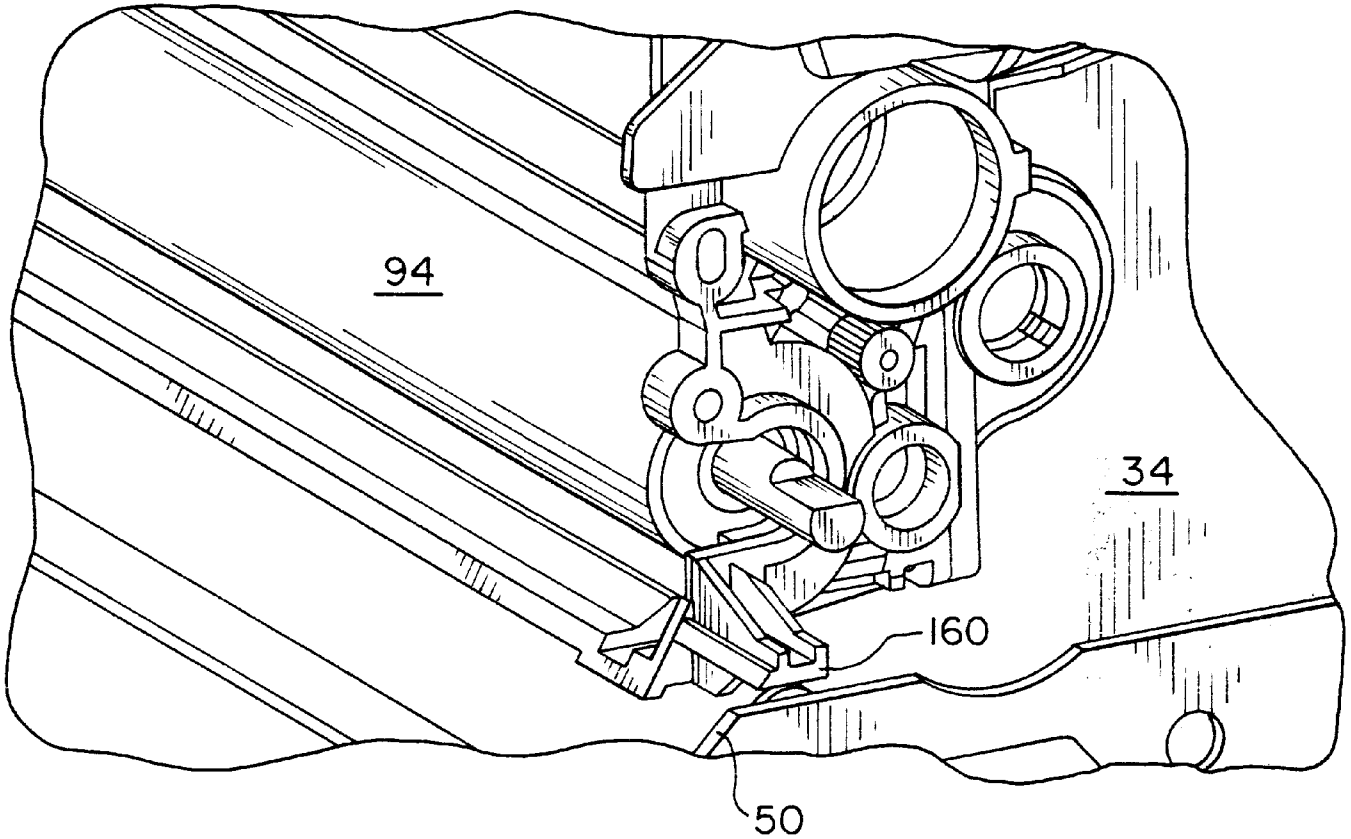
FIG. 4 is an enlarged view similar to FIG. 2, but having components of the printer removed for added clarity.

In accordance with the present invention, a developer cartridge support assembly 96 for each developer cartridge 34, also includes front v-bar 30 and back v-bar 32. Front v-bar 30 includes a plurality of front support rollers 100, 102, 104 and 106 rotatably mounted therein. Similarly, back v-bar 32 includes a plurality of back support rollers 110, 112, 114 and 116 (FIG. 3) rotatably mounted therein. Thus, each printing station 12, 14, 16 and 18 includes a front support roll 100, 102, 104 or 106 in front v-bar 30, respectively, and a back support roller 110, 112, 114 and 116 in back v-bar 32, respectively.

In a preferred structure, front support rollers 100, 102, 104 and 106 are mounted to front v-bar 30 by metal pins 120, 122, 124 and 126, respectively. Similarly, back support rollers 110, 112, 114 and 116 are rotatably mounted to back v-bar 32 by metal pins 130, 132, 134 and 136, respectively. While the present invention contemplates the use of material other than metal for pins 120, 122, 124, 126, 130, 132, 134 and 136, steel is believed to be a preferred material for its strength and low rolling resistance. Plating pins 120, 122, 124, 126, 130, 132, 134 and 136 with nickel further reduces the rolling resistance. The use of steel for pins 120, 122, 124, 126, 130, 132, 134 and 136, which are thereafter mounted in rigid front v-bar 30 and back v-bar 32 allows for more rigid attachment than previously used plastic components mounted in developer cartridge 34. Steel pins can also be of smaller diameter, thereby increasing the wheel-to-axle ratio.

To maintain the desired, precise location of developer roll 94 to PC drum 20, developer cartridge support assembly 96 further includes a reference surface 140 provided on front support roller 100. Similar reference surfaces 142, 144 and 146 are provided on front support rollers 102, 104 and 106, respectively. Similar reference surfaces 150, 152, 154 and 156 are provided for back support rollers 110, 112, 114 and 116, respectively. As an additional component of developer cartridge support assembly 96, developer cartridge 34 includes a support component in the way of a front beam 160 extending between reference surfaces 140 and 150 of support rollers 100 and 110, respectively, for supporting developer cartridge 34 on reference surfaces 140 and 150 of support rollers 100 and 110, respectively. Instead of a front beam 160 extending from front v-bar 30 to back v-bar 32, developer cartridge 34 can include individual feet for engaging surfaces 140 and 150 of support rollers 100 and 110.

Developer cartridges (not shown) for printing stations 14, 16 and 18 include front beams similar to front beam 160 of developer cartridge 34. Each developer cartridge 34 and the three remaining developer cartridges (not shown) are thus supported on front support rollers 100, 102, 104 and 106 as well as back support rollers 110, 112, 114 and 116. The location of support rollers 100, 102, 104, 106, 110, 112, 114 and 116 relative to PC drums 20, 22, 24 and 26 can be precisely controlled during the manufacture of front v-bar 30 and back v-bar 32 by precise control of the relative positions of notches 50, 52, 54 and 56 in front v-bar 30 and notches 58, 60, 62 and 64 in back v-bar 32 together with the careful location of holes for pins 120–126 and 130–136. Then, through careful control during manufacture of the developer cartridges and specifically the position of front beam 160, the relative position of each PC drum 20, 22, 24 and 26 to its respective developer roll such as developer roll 94 is controlled so that the desired nip pressure can be maintained and a parallel relationship secured.

While support rollers 100 through 106 and 110 through 116 are rotatably mounted in front v-bar 30 and back v-bar 32, respectively, the need is only to allow relative rotation through a limited range. It is not required nor does it occur that support rollers 100 through 106 and 110 through 116 roll on the associated pin 120 through 126 or 130 through 136 with any regularity. Thus, there is little or no wear on reference surfaces 140 through 146 or 150 through 156. It can be expected that the usable life of support rollers 100 through 106 and 110 through 116 will equal the expected usable life of apparatus 10, without the need for changing. In previous structures in which support rollers for a developer roll are provided in the developer cartridge, being integral with the developer cartridge, if a developer cartridge is replaced, support rollers were also replaced, often times, needlessly. In accordance with the present invention, with support rollers 100 through 106 and 110 through 116 securely mounted in front v-bar 30 and back v-bar 32, support rollers 100 through 106 and 110 through 116 can remain in the machine, securely mounted to frame assembly 28 even while developer cartridge 34 and/or other similar developer cartridges not shown for printing stations 114, 116 and 118 are replaced. The present invention eliminates needless replacement of parts and reduces the expense associated with the manufacture and supply of replacement developer cartridges 34.

Developer cartridge 34, and other similar developer cartridges not shown, includes upper support rollers such as upper support roller 162 shown for printing station 12. The support rollers on v-bars 30 and 32 for each cartridge determine the amount of skew that the developer roll will have with respect to the PC drum. The function of upper support roller 162, and other similar rear support rollers not shown, is to establish the rotational position of the cartridge developer housing about developer roll 94. Since the angular position of the cartridge developer housing 90 is not critical to function of the contact development process, it is permissible that this roller be located on a frame member remote to the v-bar assemblies.

In the use of the present invention, the locations of PC drum 20 and developer roll 94 are both referenced to the same structure, front v-bar 30 and back v-bar 32. Support rollers 100 and 110 are rigidly mounted to front v-bar 30 and back v-bar 32, respectively. Since the position of developer roll 94 is determined by front beam 160 resting on support rollers 100 and 110, developer roll 94 is referenced to the same structure as PC drum 20. The possibility of skew occurring between PC drum 20 and developer roll 94 is minimized, and the nip force between PC drum 20 and developer roll 94 is held constant throughout the length of the nip. Further, the support of developer roll 94 is more robust, with metal pins 120 and 130 mounted in front v-bar 30 and back v-bar 32, respectively. Friction from rotation of support rollers 100 and 110 is reduced, thereby minimizing yet another source of potential skew between PC drum 20 and developer roll 94. Waste is reduced by moving minimal wear components from replaceable units having shorter life expectancies, to the base machine that has a longer life expectancy. When developer cartridge 34 is removed, to be replaced by a new cartridge, support rollers 100 and 110 remain in the machine, and needless replacement is eliminated. A new cartridge and developer roll installed in the machine will again be similarly referenced to PC drum 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A photo imaging apparatus comprising;

a machine frame assembly including a photoconductive member support assembly;

a photoconductive member mounted in said photoconductive member support assembly, said photoconductive member being a drum and said photoconductive member support assembly including a front V-bar and a back V-bar having notches therein for supporting said drum;

a developer cartridge including a developer roll mounted for rotation in said cartridge for applying toner to said photoconductive member; and a developer cartridge support assembly including a reference surface mounted on said photoconductive member support assembly and a support component connected to said developer cartridge and supporting said developer cartridge on said reference surface.

2. A photo imaging apparatus comprising;

a machine frame assembly including a photoconductive member support assembly having a front V-bar and a back V-bar with notches therein;

a photoconductive drum mounted in said photoconductive member support assembly and supported in said notches;

a developer cartridge including a developer roll for applying toner to said photoconductive drum; and a developer cartridge support assembly including a reference surface mounted on said photoconductive member support assembly and a support component connected to said developer cartridge and supporting said developer cartridge on said reference surface; and said developer cartridge support assembly reference surface including support rollers mounted on said front V-bar and said back V-bar.

3. The photo imaging apparatus of claim 2, said support rollers mounted in said front V-bar and said back V-bar on metal axial support pins.

4. The photo imaging apparatus of claim 2, said support rollers mounted in said front V-bar and said back V-bar on nickel coated steel support pins.

5. The photo imaging apparatus of claim 2, said developer cartridge support assembly including a beam supporting said cartridge on said support rollers.

6. The photo imaging apparatus of claim 5, said support rollers mounted in said front V-bar and said back V-bar on axial support pins.

7. The photo imaging apparatus of claim 6, said pins being metal.

8. A contact development system for applying toner to a photoconductive drum in an electrophotographic imaging machine, comprising:

a photoconductive drum support assembly, said photoconductive drum support assembly including a front V-bar and a back V-bar;

a developer cartridge including a housing and a developer roll rotatably mounted in said housing;

a reference surface in said photoconductive drum support assembly; and a developer cartridge support connected to said developer cartridge and extending between said cartridge and said reference surface.

9. A contact development system for applying toner to a photoconductive drum in an electrophotographic imaging machine, comprising:

a photoconductive drum support assembly including a front V-bar and a back V-bar;

a developer cartridge including a housing and a developer roll rotatably mounted in said housing;

a reference surface in said photoconductive drum support assembly; and a developer cartridge support connected to said developer cartridge and extending between said cartridge and said reference surface, said photoconductive drum support assembly including a front V-bar and a back V-bar; and said reference surface including developer roll support rollers mounted on said front V-bar and said back V-bar.

10. The contact development system of claim 9, including metal pins securing said support rollers to said front and back v-bars.

11. The contact development system of clam 9, said developer cartridge support including at least one leg connected to said housing and supported on said rollers.

12. The contact development system of claim 11, including pins in said front and back v-bars, and said rollers mounted on said pins.

13. The contact development system of claim 12, said pins being metal.

14. The contact development system of claim 12, said pins being nickel coated steel.

15. A developer roll referencing apparatus for a contact developing system in an electrophotographic imaging machine having a machine frame including a PC drum support assembly and a photoconductive drum mounted in said PC drum support assembly, said development system including a developer cartridge having a housing and a developer roll, said referencing apparatus comprising:

a reference surface in said PC drum support assembly; and a support component for said cartridge, said support component being connected to the developer cartridge and disposed on said reference surface; and said reference surface including support roller.

16. The referencing apparatus of claim 15, said support roller rotatably mounted on a pin.

17. The referencing apparatus of claim 16, said pin being metal.

18. The referencing apparatus of claim 16, said pin being nickel coated steel.

19. A developer roll referencing apparatus for a contact development system in an electrophotographic imaging machine having a machine frame including a PC drum support assembly and a photoconductive drum mourned in said PC drum support assembly, said development system including a developer cartridge having a housing and a developer roll rotatably mounted in the housing, said referencing apparatus comprising:

a reference surface in said PC drum support assembly;

a support component for said cartridge, said support component being connected to the developer cartridge and disposed on said reference surface, and;

said machine frame including a front V-bar and a back V-bar, said photoconductive drum mounted in notches in said front V-bar and said back V-bar, and said reference surface including support rollers mounted on said front V-bar and said back V-bar.

20. The referencing apparatus of claim 19, said support component including a beam extending between said support rollers.

* * * * *